US007749043B1

(12) United States Patent
Rehkemper et al.

(10) Patent No.: US 7,749,043 B1
(45) Date of Patent: Jul. 6, 2010

(54) INTERACTIVE TOY AND AREAS DESIGNATED THEREFOR

(75) Inventors: Steven Rehkemper, Chicago, IL (US); Jeffrey Rehkemper, Chicago, IL (US); Dennis O'Patka, Chicago, IL (US); Jackson Wilson, Evanston, IL (US); Michael Kass, Willowbrook, IL (US); Nicholas Grisolia, Chicago, IL (US)

(73) Assignee: REHCO, LLC, Chicago, IL (US)

( * ) Notice: Subject to any disclaimer, the term of this patent is extended or adjusted under 35 U.S.C. 154(b) by 903 days.

(21) Appl. No.: 11/207,244

(22) Filed: Aug. 19, 2005

Related U.S. Application Data

(60) Provisional application No. 60/625,425, filed on Nov. 5, 2004.

(51) Int. Cl.
*A63H 30/00* (2006.01)
*G06F 19/00* (2006.01)

(52) U.S. Cl. ..... 446/175; 700/262

(58) Field of Classification Search ..... 446/454–456, 446/175; 700/262
See application file for complete search history.

(56) References Cited

U.S. PATENT DOCUMENTS

| | | | | |
|---|---|---|---|---|
| 3,555,722 | A * | 1/1971 | McLain | 446/293 |
| 4,828,525 | A * | 5/1989 | Okano | 446/175 |
| 6,925,358 | B2 * | 8/2005 | Chiu | 700/245 |
| 2007/0293119 | A1 * | 12/2007 | Sosnovskiy | 446/175 |

* cited by examiner

*Primary Examiner*—Peter DungBa Vo
*Assistant Examiner*—Alex F. R. P. Rada, II
(74) *Attorney, Agent, or Firm*—Adam K. Sacharoff; Much Shelist

(57) ABSTRACT

In accordance with the present invention an interactive toy includes a body, a head extending from a front portion of the body and a plurality of feet extending downwardly from the body. A pair of sensors are separately positioned on the left and right sides of the toy, and the sensors activate upon receiving a signal. A microprocessor is in communication with the pair of sensors controls a mechanical movements of the toy upon activation of the sensors. In one embodiment the mechanical movements of the toy include a pair of motors separately driving a gear spur meshed to a wheel. Each wheel extends from underneath the toy to drive the toy on a surface.

10 Claims, 12 Drawing Sheets

INTERACTIVE TOY AND AREAS DESIGNATED THEREFOR

CROSS REFERENCE TO RELATED APPLICATIONS

The present application claims priority to U.S. Provisional Application 60/625,425 filed on Nov. 5, 2004.

FIELD OF THE INVENTION

The present invention relates to an interactive moving toy, such as a plush figure or animal, that has an area or enclosure that the figure automatically returns to and enters.

BACKGROUND OF THE INVENTION

Interactive toys are well known in the prior art. A toy created by one of the current inventors included a toy vehicle that returned to and entered a "garage." However, various improvements in returning a toy to an area or enclosure are desired. For example, toys are often placed on tracks or rails to direct and guide a toy into an enclosure. And a toy's ability to enter into a designated area or enclosure and turn around such that it is facing out is often limited to having tracks or rails in the designated area. It is thus an improvement over the prior art to provide a toy that can be freely directed without tracks or rails into a designated area and have the toy automatically turn around. In addition, it is desired to have a toy that if placed around the side of the area could use sensing devices to move itself and maneuver into a proper position and automatically guide itself into the area.

SUMMARY OF THE INVENTION

In accordance with the present invention an interactive toy includes a body, a head extending from a front portion of the body and a plurality of feet extending downwardly from the body. A sensor is positioned on the left and right sides of the toy, and the sensors activate upon receiving a signal. A microprocessor, which is in communication with the pair of sensors, controls a mechanical means to move the toy upon activation of the sensors. In one embodiment the means to move the toy includes a pair of motors separately driving a gear spur meshed to a wheel. Each wheel extends from underneath the toy to drive the toy on a surface.

The toy may also include a pair of feet positioned on either side of the toy. Each foot includes a bottom portion secured to a cam that is driven by a gear train meshed to the gear spur. And each foot includes a slot in a top portion sized to receive a pin secured to the body of the toy. Thus when the gear spur rotates, each foot moves up and down while the bottom portion reciprocates.

The toy may also include a lead switch positioned in the front end of the toy and in communication with the microprocessor that will play preprogrammed responses upon activation of the lead switch. The lead switch has a portion extending outwardly from the front end of the toy that when pulled activates the lead switch.

In another aspect of the invention, the toy is used in connection with a designated area therefor. The designated area has an entrance, and a transmitter positioned within the designated area for sending a signal out of the entrance. The microprocessor will guide and move the toy through the entrance of the designated area when the toy's sensors receive the signal from the transmitter.

In another aspect of the invention, the toy includes a reference pointer sensor positioned underneath the toy and in communication with the microprocessor that plays preprogrammed responses upon activation of the reference pointer sensor. The reference pointer sensor is used in connection with pointers on the floor of the designated area. The microprocessor controls and moves the toy within the designated area as the toy moves over the pointers on the floor such that the toy is able to turn itself around and face out the entrance of the designated area.

In another aspect of the invention the toy includes pairs of transmitter/sensors, and has a microprocessor that moves the toy in response to the sensors receiving signals reflected off of an obstacle on the surface. The toy is thus able to automatically maneuver around such obstacles and orient itself to a proper position for entering the designated area.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
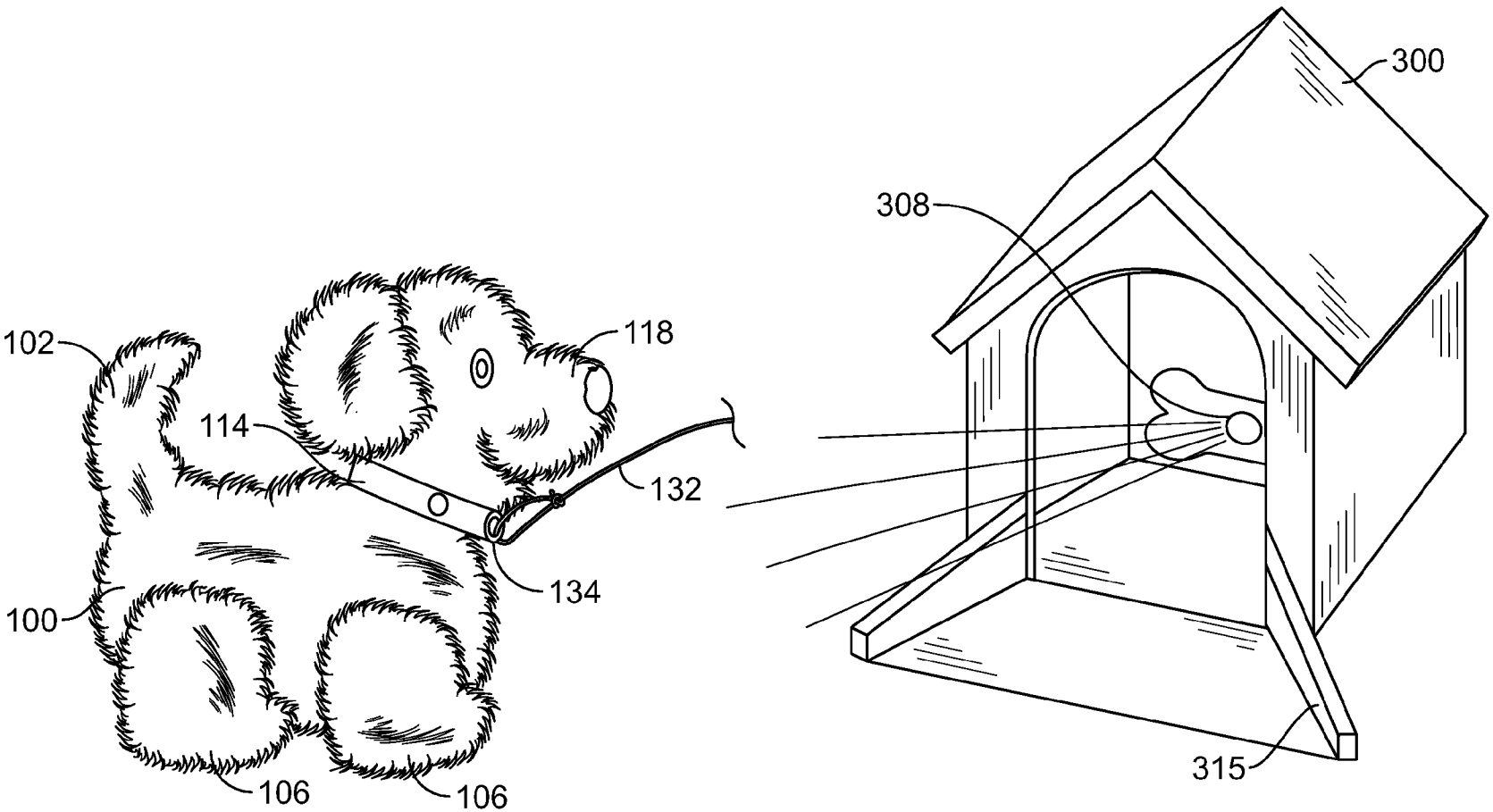
FIG. 1 is a perspective view of a toy and enclosure therefor in accordance with the present invention.
Figure 2:
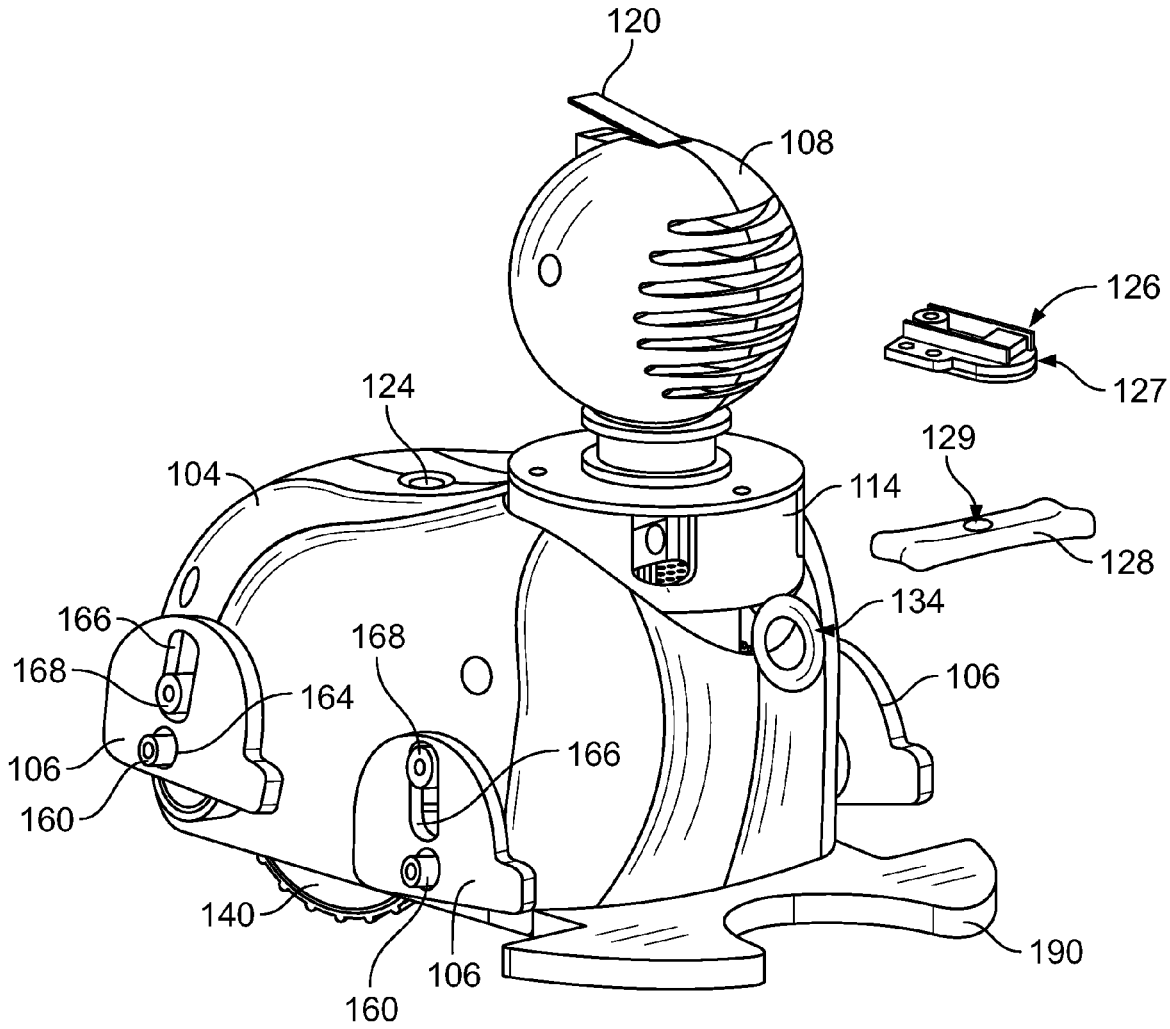
FIG. 2 is a perspective view of the toy without its outer covering.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, in accordance with the present invention, an interactive moving toy 100 is shown along with a designated area 300 or in this instance an enclosure. The toy is illustrated as a animal, however, the toy's shape or appearance can change without effecting the scope of the invention. In addition, the appearance or shape of the designated area 300 may relate to the toy's appearance. For example, if the toy is a car the designated area may be a car port or garage, alternatively, if the toy is a dog, the designated area may be dog house or have the appearance of a fenced yard. It is important to note that the designated area may or may not include walls, roofs or related items.

The toy 100, shown without its outer covering 102 in FIGS. 2-5, includes a body 104. In the present exemplary embodiment, the toy 100 includes various appendages extending from the body 104. The appendages include legs 106 and a head 108. The toy 100 also includes switches positioned about the body that when activated sets off specific pre-programmed responses that are stored on a microprocessor 110. For example, the toy 100 includes a head switch 120 that when a user actives by rubbing or pressing the user's hand across the top of the head 108, activates a set of pre-programmed responses. The pre-programmed responses may include movement and/or sound responses. The movement of the toy 100 is explained in detail below. The sound responses are emitted through a speaker 122. Various pre-recorded sounds may be stored on the microprocessor 110.

The toy 100 may also include a sound activated switch or microphone 124, which when activated by a loud sound sets off specific pre-programmed responses that are stored on the microprocessor 110. Similarly, the responses may include movement and/or sound responses.

The toy 100 may also include a mouth switch or sensor 126 positioned in the front of the head 108. If a mouth switch is used (such as a mechanical switch) the switch will activate when a user presses a object (such as a dog toy 128) into the mouth switch. The mouth switch preferably is configured to also frictionally grab and hold onto the object. As such, as long as the bone 128 is pressed and held against the mouth switch, the activation of the switch will cause the microprocessor to run a set of pre-programmed responses. If a mouth sensor 126 is used, a magnet 127 positioned in the mouth sensor engages and holds onto a magnet 129 positioned in the bone 128. The mouth switch or sensor would be sewn into the outer covering 102.

The toy 100 may further include a lead switch 130 positioned about or below the neck or collar portion 114. When the lead switch 130 is pulled it is activated, causing the microprocessor to run a set of pre-programmed responses. The pre-programmed responses could move the toy backwards such as in a tug of war or could move the toy forwards such as if the toy was following the user. A leash 132 can be removably attached to the lead switch 130 by providing a clip (not shown) that the user secured around a ring 134 operatively secured to the lead switch 130. When the user pulls the leash 132, the ring 134 pulls and activates the lead switch 132. The lead switch 130 may automatically return to the off position once the leash is released. However, once the lead switch 130 is activated, the microprocessor may run the pre-programmed responses in their entirety or randomly, and will keep playing the pre-programmed responses as long as the lead switch is subsequently activated.

The toy 100 moves along a surface through a pair of wheels 140 that partially protrude from a bottom plate 116 in the body 104 of the toy 100. As further explained below, when the wheels 140 are rotating, the legs 106 of the toy 100 move up and down and back and forth providing the appearance that the legs 106 are moving the toy.

Figure 5:
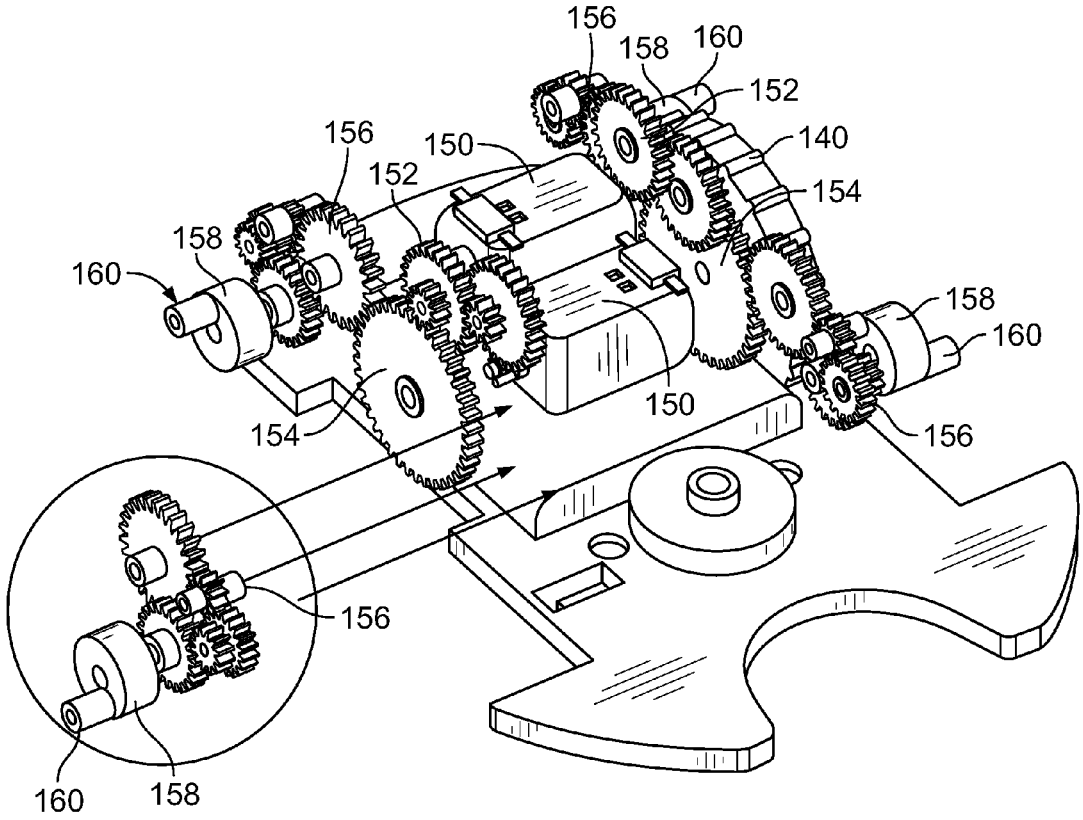
FIG. 5 is a perspective view of the motor and drive train used to rotate the wheels and reciprocate the legs of the toy.

To drive the wheels 140 and reciprocate the legs 106, the toy 100 includes a pair of motors 150. Depending upon the type of movement desired the number of motors may change and dedicated motors may be used to reciprocate the legs. As shown in FIG. 5, the pair of motors separately operate one side of the toy 100, with each side including identical gear trains. Each motor 150 drives a first gear train 152 that is meshed to a drive spur 154 attached to a wheel 140.

Branching from the drive spur 154 are a pair of foot gear trains 156, one branching to the front and one branching to the rear. Meshed to the end of each foot gear train 156 is a cam 158 with a knob 160 extending outwardly therefrom. Each leg 106 has an opening 164 (see FIG. 2) to accommodate the knob 160 and has a slot 166 that accommodates a pin 168 secured to the body 104 of the toy. As the cam 158 rotates the knob 160 reciprocates the leg 106 back and forth. In addition, the slot 166 allows the leg 106 to slide up and down during upward and downward movement of the cam, giving the overall appearance that the leg is moving in an up and down, back and forth movement.

The motors 150 are controlled through the microprocessor 110 and switch 124 such that movement may be made forwards, backwards, left turns, right turns and spins. In a forward direction both motors are moving the wheels 140 forwards. In a backwards direction both motors are moving the wheels 140 in a reverse direction. In a left or right turn, only one motor is operating, causing the toy to turn in the direction of the stalled motor or non-rotating wheel. To spin the toy, the motors rotate the wheels in reverse directions to each other.

The toy 100 also includes a caster wheel 170 positioned towards the front of the toy and a pair of skids 172 positioned in the rear of the toy. The caster wheel and skids provides extra stability when the toy is moving. In addition, the toy 100 may include an on/off switch 178 and an enclosure sensor 176. The enclosure sensor 176 is used to orient the toy 100 when it is inside the designated area, explained in greater detail below.

Figure 6:
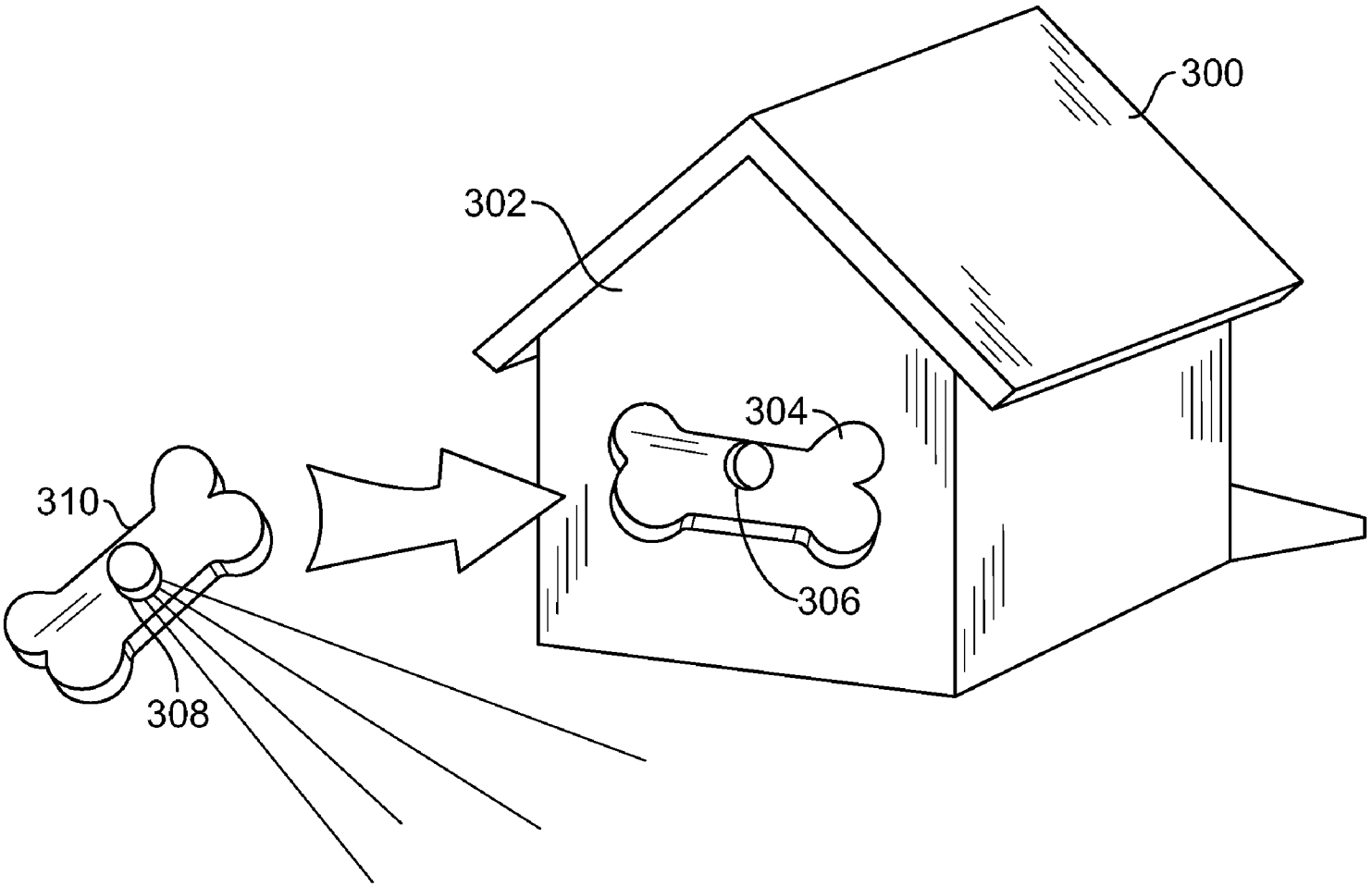
FIG. 6 is a back perspective view of the enclosure and a transmitter.

Referring now to FIG. 6, the designated area 300 has an exterior back portion 302 with an indented section 304, which matches an object or bone 310. Within the indented section 304 is an aperture 306 to the interior of the designated area that will permit a transmitter 308 in the bone 310 to emit a signal through the designated area 300, when the bone 310 is positioned in the indented section 304. The designated area 300 also includes an entrance opening with walls on either side connecting the entrance to a back wall. The bone 310 may also be removed from the designated area 300 and used separately apart therefrom. The user may angle the bone 310 towards the toy 100 such that the transmitter 308 emits a signal that is received by the toy 100. The toy 100 can then follow the user or bone 310 around.

Figure 3:
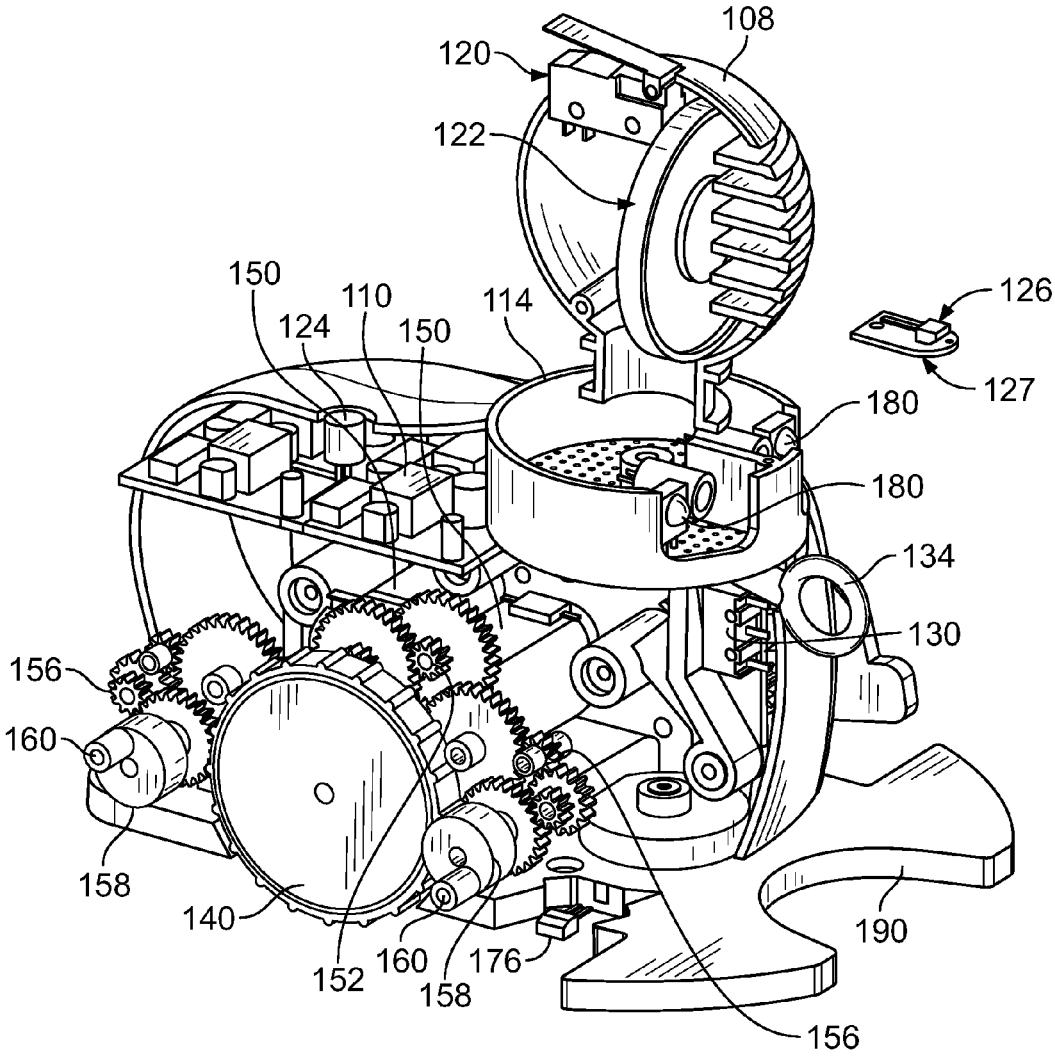
FIG. 3 is a sectional view of the internal components of the toy.
Figure 4:
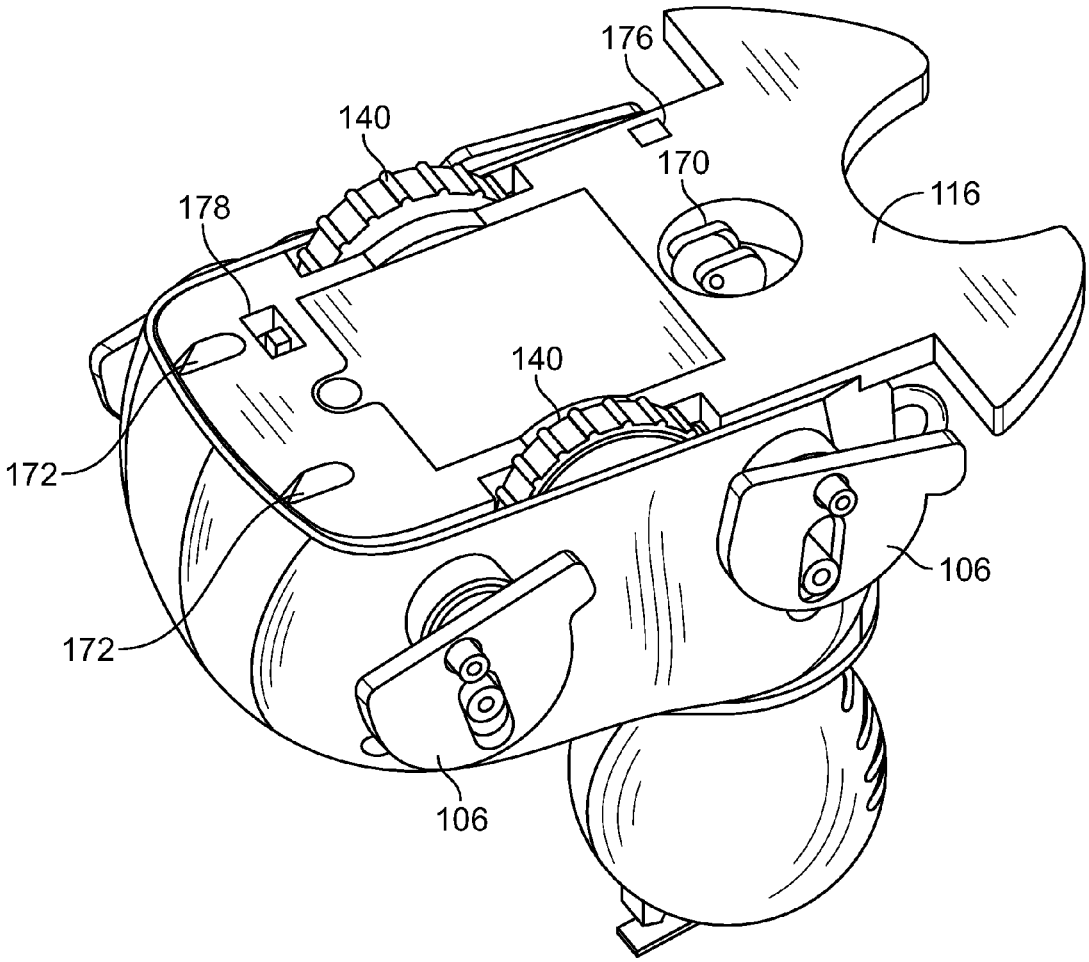
FIG. 4 is a bottom perspective view of the toy.
Figure 7:
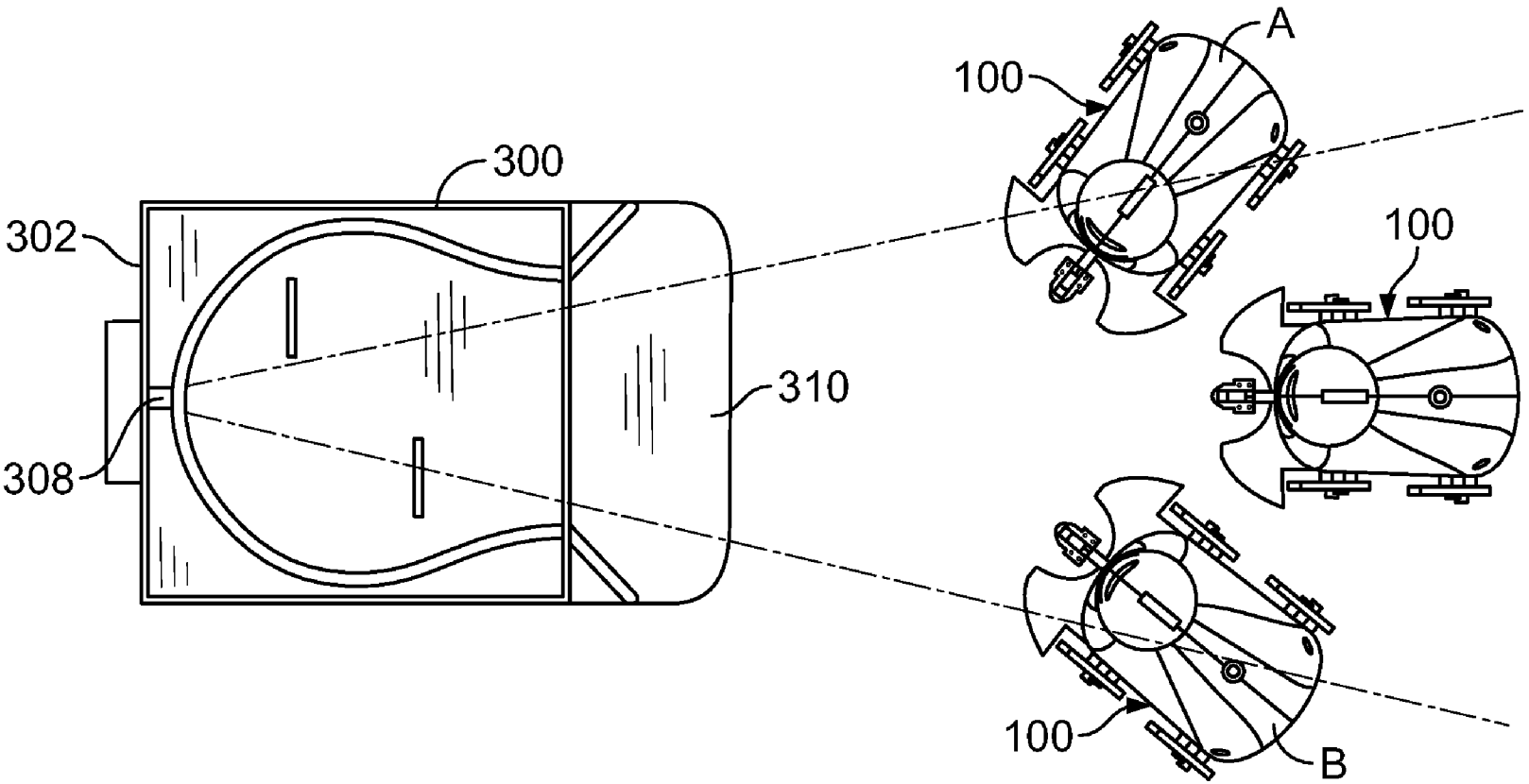
FIG. 7 is a top view of a toy positioned at three different angles towards the entrance of the enclosure.

Referring now to FIGS. 3 and 7, the toy 100 includes a pair of receivers 180, positioned in the collar section 114. The receivers 180 are slightly recessed to help keep the receivers 180 separated and the reception of signals clearer. The toy 100 may enter a programming mode or phase that directs the toy to "go home." This phase may be initiated upon the activation of a switch or sensor. In this mode, the toy 100 begins to look for a signal emitting from the entrance 310 of the designated area 300. When the toy 100 is positioned at an angle to the entrance of the designated area, such as in positioned A or B, only one of the receivers 180 is sensing the transmitted signal.

The microprocessor will continually cause the toy to move or turn the toy until both sensors 180 are receiving the signal. In addition, if the toy 100 is 180° from the entrance 310 and neither sensor 180 is receiving a signal, the motors 150 may spin the toy until a sensor 180 begins to receive the signal.

Figure 8:
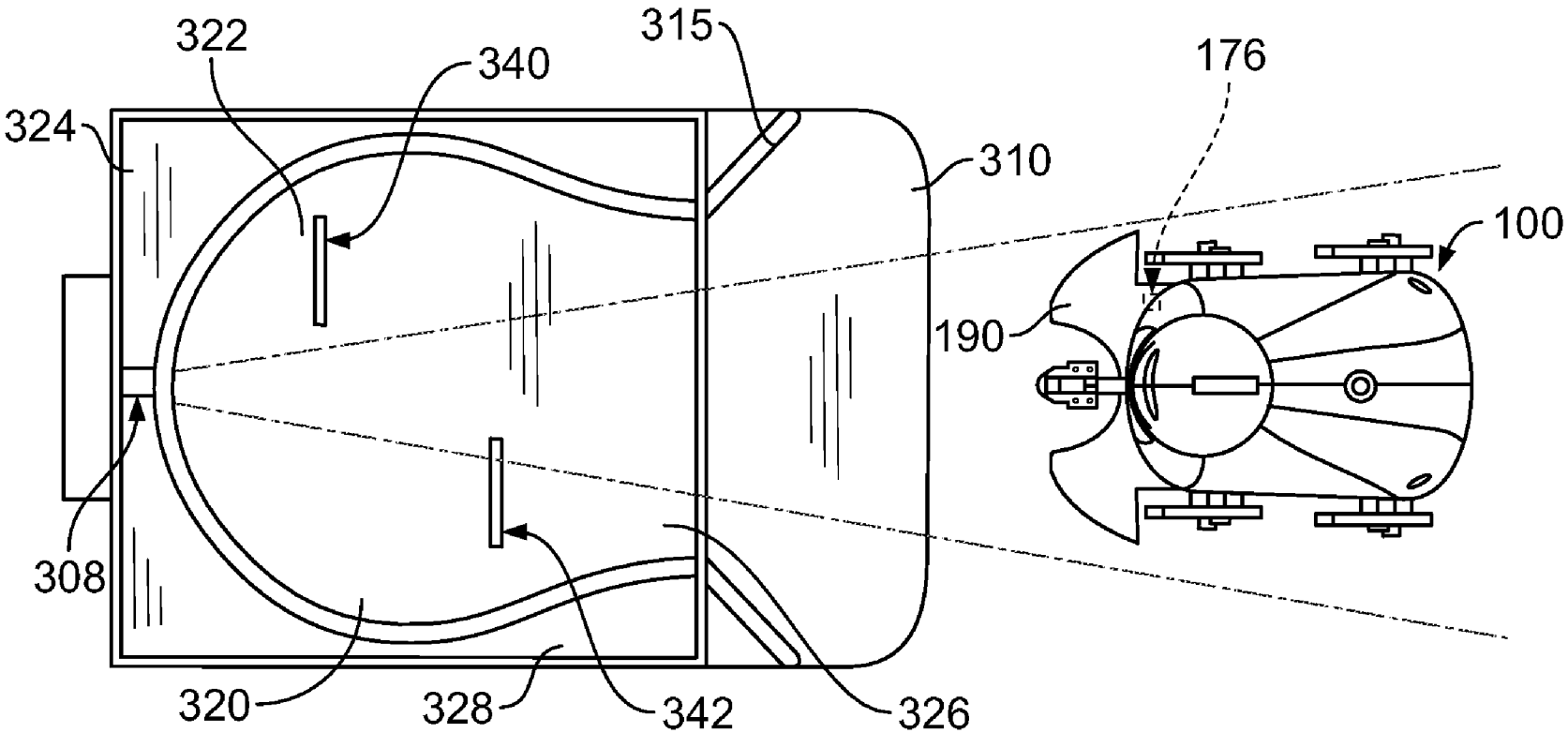
FIG. 8 is a top view of the toy and enclosure illustrating the magnetic strips and rails used to guide and orient the toy within the enclosure.

Referring now to FIG. 8, once the toy 100 begins entering the designated area 300, both the toy 100 and the designated area 300 employ a means to help properly guide the toy into the designated area 300. The designated area 300 includes a rail 315 and the toy 100 includes a railing guard 190 that extends outwardly from the bottom plate 116 in the body 104 of the toy 100. If the guard 190 comes into contact with the rail 315, the toy is pushed towards the correct position in the designated area. The rail 315 does not extend into the designated area 300 and is used only to help position the toy 100. The rail 315 is not used to turn the toy 100 around once inside the designated area.

Continuing to refer to FIG. 8, in addition, the designated area and the toy further include a means to orient the toy such that the toy is turned around in the designated area to face the toy towards the outside. The orientation means used is preferably a pair of position reference pointers, such as magnetic pointer or optical pointers 340, 342 positioned on the floor 320 of the designated area 300. A first position reference pointer 340 is positioned in a first corner 322 of the back portion 324 of the designated area 300, and a second position reference pointer 342 is positioned in a second corner 326 that is diagonal from the first corner (or in the front portion 328 of the designated area 300. As mentioned above the toy 100 includes a position reference sensor 176. While the toy 100 is in the designated area, the position reference sensor 176 is activated by moving over the first position reference pointer 340, the microprocessor spins the toy 100 until the position reference sensor 176 is activated by the other position reference pointer 342. At this point the toy 100 has turned around inside the designated area and is facing outwardly. Once in the designated area, a noise or sound may activate the toy's sound sensor 124 causing the microprocessor to move the toy forwards and out of the designated area. Additional position reference pointers may be positioned in the designated area to turn or orient the toy in different directions. In other embodiments, the position reference pointers 342 may cause the toy to stop at a predetermined position, for example, if the enclosure included a window, the toy may stop to look out the window and then after a predetermined time or after hearing a noise may continue to orient itself such that it is facing out of the designated area. Moreover, the predetermined position may itself be such that the toy is facing out of the designated area.

Figure 9:
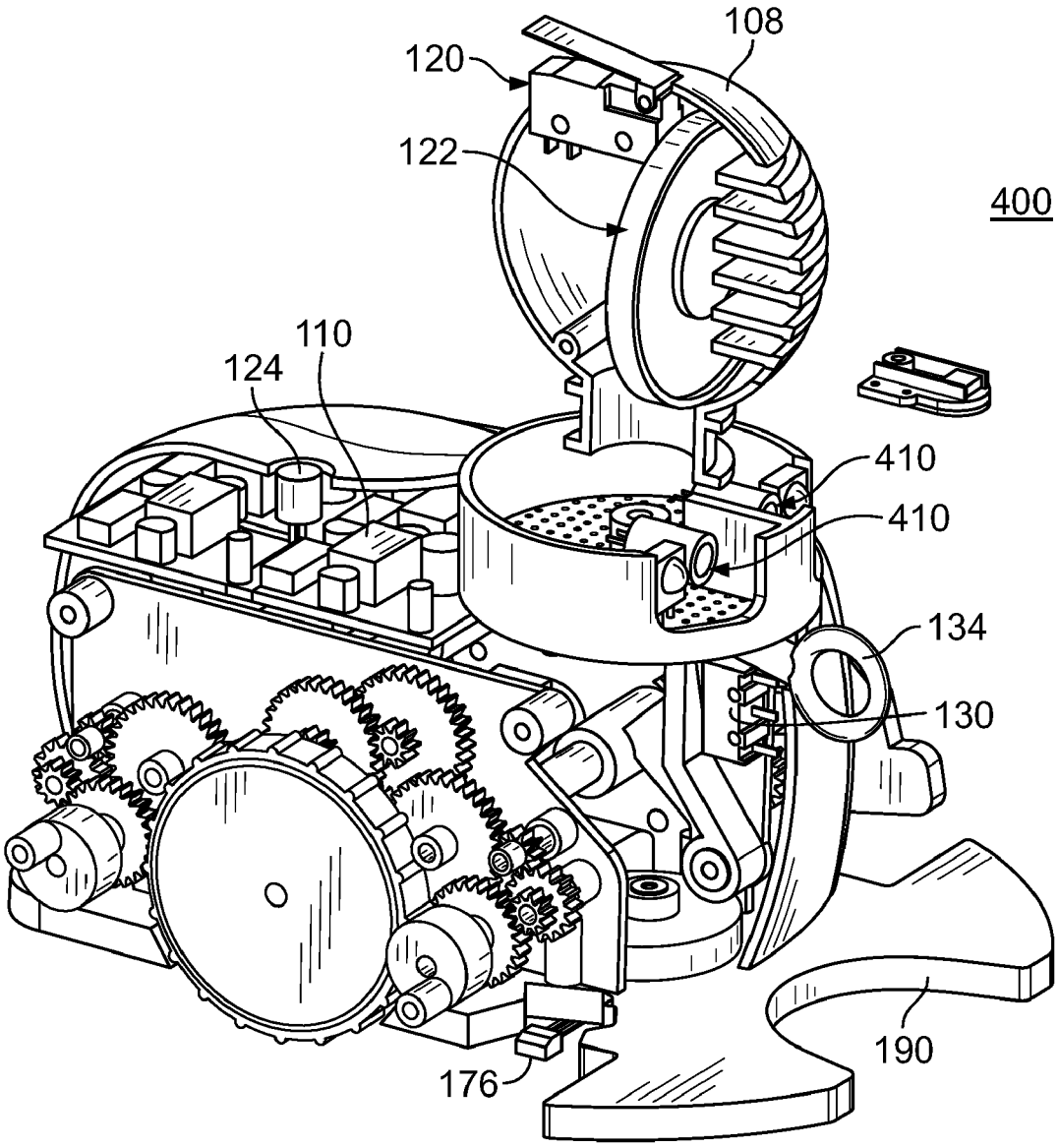
FIG. 9 is a sectional view of the internal components of another embodiment of the toy having a pair receiver/transmitters.

In another embodiment of the present invention, the toy 400, illustrated in FIG. 9, may include a pair of receiver/transmitters 410 positioned on either side of the toy. The receiver/transmitters work in concert to move and orient the toy inside the designated area, especially within an enclosure. As the transmitter is bounced off of the interior of the enclosure, the receiver can identify the bounced signal which in turn causes the microprocessor to move the toy until the toy is facing out of the enclosure.

Figure 10A:
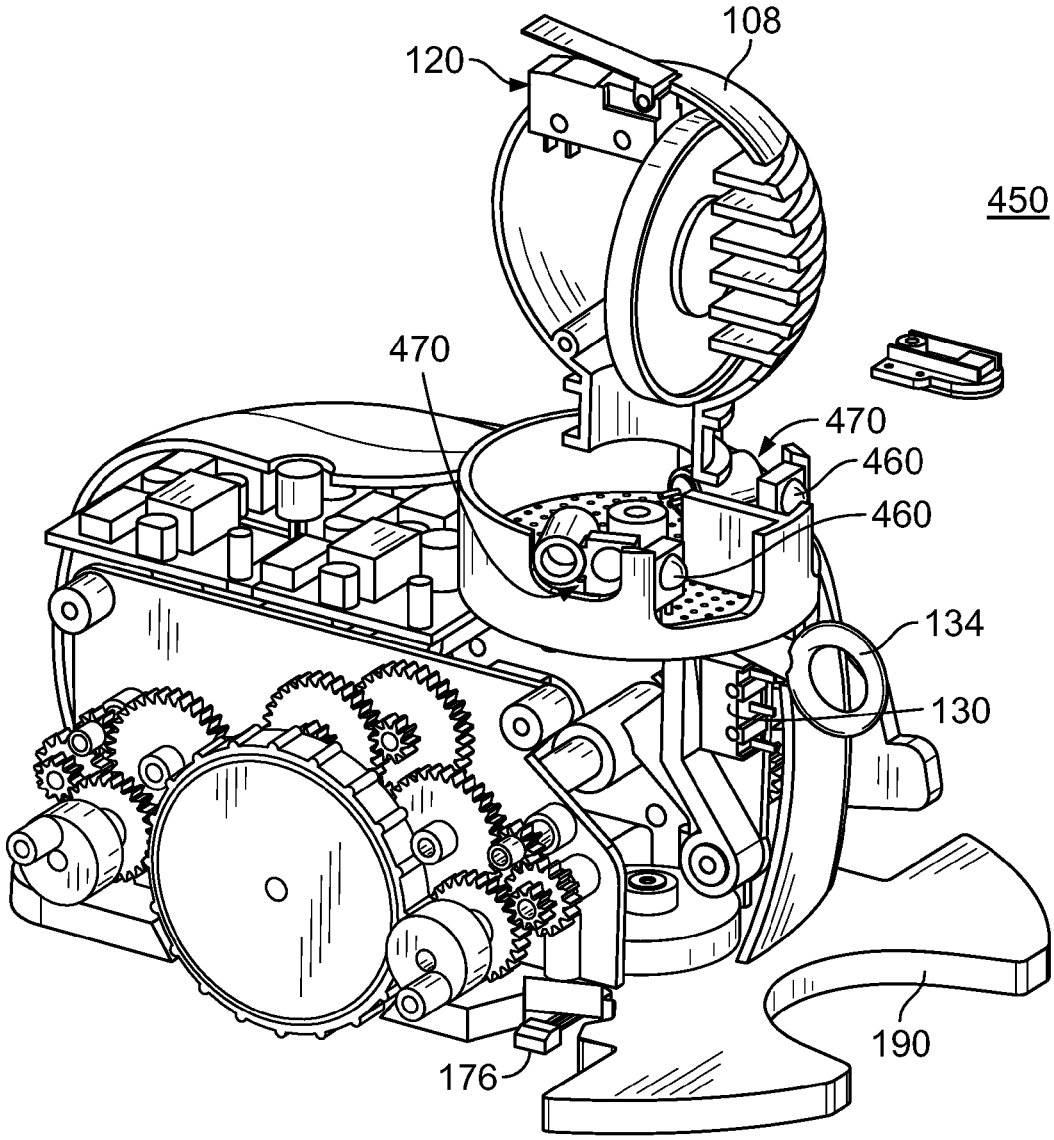
FIG. 10*a* is a sectional view of the internal components of another embodiment of the toy having a pair receivers on either side of the toy and a pair of receiver/transmitters on either side of the toy to help maneuver the toy around objects.
Figure 10B:
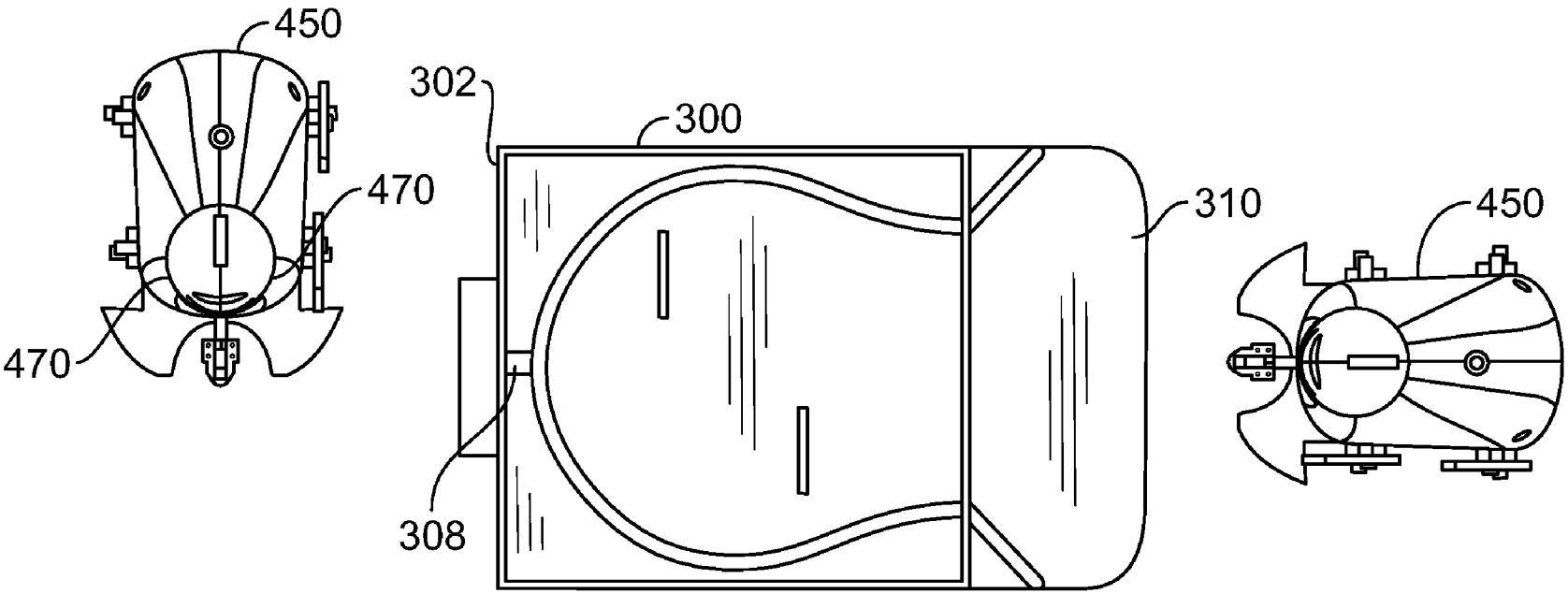
FIG. 10*b* illustrates the toy from FIG. 10*a* being able to move around a designated area and which is capable of orienting itself into position to move into the designated area.

Referring now to FIG. 10*a*, in another embodiment, the toy 450 includes a pair of receivers 460 to receive and recognize a signal emanating from within the designated area or from a bone, as mentioned above, will cause the toy to move and orient itself such that the toy can enter the designated area. The toy 450 also includes a pair of receiver/transmitters 470 oriented on either side of the toy 450. This receiver/transmitters 470 permits the toy to move itself around objects or the outside perimeter or walls of the designated area until it is oriented towards the entrance and until the toy 450 picks up the transmitted signal from inside of the designated area and then the toy 450 would go inside the designated area, See FIG. 10*b*.

Figure 11:
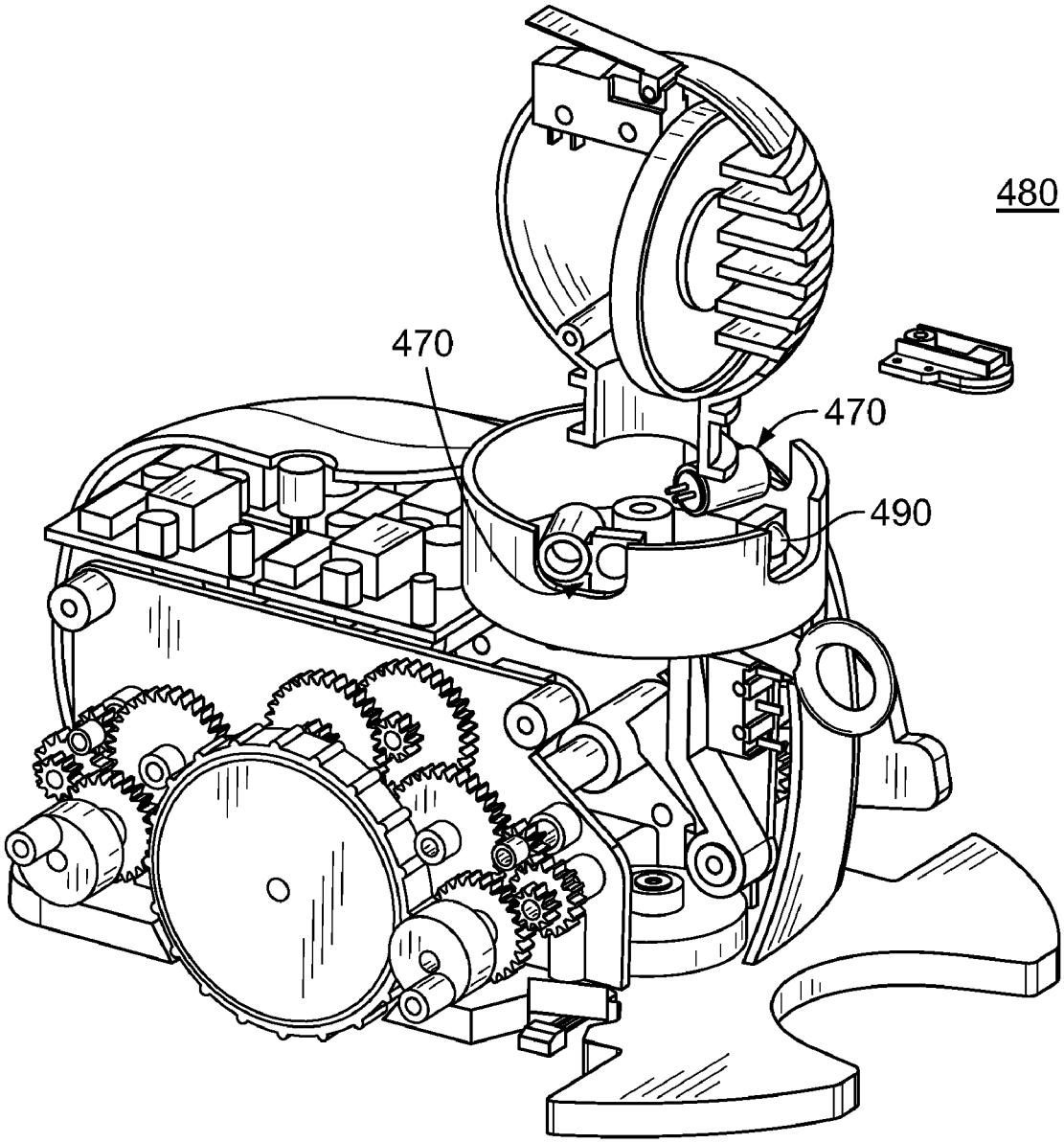
FIG. 11 is a sectional view of the internal components of another embodiment of the toy having a pair receiver/transmitters on either side of the toy and a single receiver in the front of the toy.

Referring now to FIG. 11, in another embodiment, the toy 480 includes a pair of receiver/transmitters 470 oriented on either side of the toy 480, permitting the toy to move itself around objects or the outside perimeter or walls of the designated area. The toy 480 also includes a single receiver 490 positioned directly in front of the toy 480. The single receiver 490 works with a single coming out of the designated area to orient the toy 480 in a position to move into the designated area.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. An interactive toy having a left side and a right side, the toy further comprising:

a body, a head extending from a front portion of the body and a plurality of appendages extending downwardly from the body;

a microprocessor;

a sensor positioned on the either side of the toy, the sensors are operatively connected to the microprocessor and activate upon receiving a signal;

a first magnetic sensor positioned underneath the toy and a second magnetic sensor positioned in the front end of the toy, the first magnetic sensor and the second magnetic sensor being in communication with the microprocessor, the microprocessor having controls to play preprogrammed responses upon activation of the first magnetic sensor and the second magnetic sensor;

a mechanical means to move the toy controlled by the microprocessor;

programming defined on the microprocessor to control the means to move the toy, wherein the microprocessor controls the movement of the toy in response to the activation of the sensors; and a designated area having a removable transmitter positioned when the designated area for sending a signal out of the entrance of the designated area, the toy upon receiving said signal from the designated area will move the toy through said entrance and into said designated area.

2. The toy of claim 1, wherein positioned about each sensor is a corresponding transmitter, each transmitter sending a signal outwardly from said toy and each sensor being activated upon the reception of the signal bounced off of an object, the microprocessor having programming to move the toy about an object as a sensor receives said reflected signal.

3. The toy of claim 1 wherein the means to move the toy includes a pair of motors, each motor separately drives a gear spur meshed to a wheel, each wheel extends from underneath said toy to drive the toy on a surface.

4. The toy of claim 3 wherein the toy further includes a pair of feet positioned on either side of the toy, each foot includes a bottom portion secured to a cam that is driven by a gear train meshed to the gear spur, and includes a slot in a top portion sized to receive a pin secured to the body of the toy, wherein when said gear spur rotates, each foot moves up and down while the bottom portion reciprocates.

5. The toy of claim 3 further comprising a caster wheel positioned underneath a front end of the toy and a pair of skids positioned underneath a rear end of the toy.

6. The toy of claim 1, wherein the preprogrammed responses includes moving the toy.

7. The toy of claim 6, wherein the preprogrammed responses includes emitting sounds from a speaker.

8. The toy of claim 1 further comprising a lead switch positioned in the front end of the toy and in communication with the microprocessor, the microprocessor having controls to play preprogrammed responses upon activation of the lead switch, the lead switch having a portion extending outwardly from the front end of the toy that when pulled activates the lead switch and when released, the lead switch is deactivated.

9. The toy of claim 1, wherein the microprocessor has programming to move the toy in response to receiving the signal, such that when only one of said sensors receives said signal, said programming moves and orients the toy until both sensors receive said signal.

10. The toy of claim 9, wherein the designated area further includes a floor with at least two magnetic pointers separately positioned on either side of the floor of the designated area, the two magnetic pointers further defined as a first magnetic pointer being positioned towards a rear portion of the designated area and a second magnetic pointer being positioned towards the entrance of the designated area, said magnetic sensor of said toy is positioned towards one side of the toy, such that when the toy enters the designated area, the toy moves towards the rear portion of the designated area until the magnetic sensor moves over the first magnetic pointer and activates said magnetic sensor causing the microprocessor to rotate said toy until said toy moves over said second magnetic pointer which activates said magnetic sensor a second time to cause the microprocessor to stop the movement of said toy whereby when said toy enters the designated area, the toy automatically turns around in said designated area to face towards the entrance.

* * * * *